US007828474B2

(12) United States Patent
Ishizuka et al.

(10) Patent No.: US 7,828,474 B2
(45) Date of Patent: Nov. 9, 2010

(54) SHOT PUMP AND VARIABLE-SPEED-TYPE TWO-LIQUID METERING AND MIXING APPARATUS

(75) Inventors: Junji Ishizuka, Hiratsuka (JP); Yoshinobu Ohashi, Hiratsuka (JP); Kiminori Araki, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 583 days.

(21) Appl. No.: 11/884,508

(22) PCT Filed: Mar. 15, 2006

(86) PCT No.: PCT/JP2006/305118

§ 371 (c)(1), (2), (4) Date: Aug. 16, 2007

(87) PCT Pub. No.: WO2006/100979

PCT Pub. Date: Sep. 28, 2006

(65) Prior Publication Data

US 2010/0046320 A1 Feb. 25, 2010

(30) Foreign Application Priority Data

Mar. 18, 2005 (JP) ..... 2005-079511

(51) Int. Cl.
*B01F 15/04* (2006.01)

(52) U.S. Cl. ..... 366/160.4; 92/162 R; 222/137; 222/145.6; 417/559

(58) Field of Classification Search ..... 366/132, 366/134, 151.1, 160.1–160.5, 162.3, 182.1, 366/152.1, 152.2, 162.1; 222/134, 135, 137, 222/145.1, 145.5, 145.6; 92/162 R, 261; 417/559, 569, 900, 539
See application file for complete search history.

(56) References Cited

U.S. PATENT DOCUMENTS 3,908,862 A * 9/1975 Chandra et al. ..... 222/63
3,912,234 A * 10/1975 Peter ..... 366/262
4,090,695 A * 5/1978 Stone et al. ..... 366/76.2
4,171,191 A * 10/1979 Krueger ..... 417/539

(Continued)

FOREIGN PATENT DOCUMENTS

JP 59-103975 6/1984

(Continued)

*Primary Examiner*—Charles E Cooley
(74) *Attorney, Agent, or Firm*—Greer, Burns & Crain, Ltd.

(57) ABSTRACT

A shot pump including a cylinder standing upright and an inlet having a check valve which allows a paste-like transferred substance to only flow into the cylinder therethrough. The shot pump also includes an outlet having a check valve which allows the transferred substance to only flow out of the cylinder therethrough. Additionally, a piston is configured to vertically reciprocate in the cylinder, causing the transferred substance to be sucked from the inlet and then to be discharged from the outlet. The ratio of a clearance between a side face of the piston and an inner side face of the cylinder to an outside diameter of the piston is 1/50 to ½. The transferred substance is sucked from the inlet, is then caused to pass through the clearance between the side face of the piston and the inner side face of the cylinder, and is discharged from the outlet.

3 Claims, 7 Drawing Sheets

U.S. PATENT DOCUMENTS

| | | | | |
|---|---|---|---|---|
| 4,312,463 | A * | 1/1982 | Daby | 222/134 |
| 4,339,233 | A * | 7/1982 | Krueger | 417/317 |
| 5,540,562 | A | 7/1996 | Giter | |
| 5,769,615 | A | 6/1998 | Giter | |
| 6,161,956 | A * | 12/2000 | Jerkel | 366/160.4 |
| 6,315,442 | B1 * | 11/2001 | Jerkel | 366/160.4 |
| 2006/0203609 | A1 * | 9/2006 | Danielson et al. | 366/162.1 |
| 2006/0209623 | A1 * | 9/2006 | Duschanek et al. | 366/159.1 |
| 2009/0280034 | A1 * | 11/2009 | Ballu | 422/105 |
| 2010/0046320 | A1 * | 2/2010 | Ishizuka et al. | 366/152.2 |

FOREIGN PATENT DOCUMENTS

| | | |
|---|---|---|
| JP | 100346/1989 | 4/1991 |
| JP | 6-55552 | 1/1994 |
| JP | 9-88814 | 3/1997 |
| JP | 9-512614 | 12/1997 |
| JP | 10-18977 | 1/1998 |
| JP | 11-50954 | 2/1999 |

* cited by examiner

SHOT PUMP AND VARIABLE-SPEED-TYPE TWO-LIQUID METERING AND MIXING APPARATUS

TECHNICAL FIELD

The present invention relates to a shot pump for transferring a paste-like adhesive agent or the like, and a variable-speed-type two-liquid metering and mixing apparatus using the shot pump. Specifically, the present invention relates to a shot pump making it possible to avoid a failure caused, for example, by a gelated substance to be transferred that remains in the shot pump, and also relates to a variable-speed-type two-liquid metering and mixing apparatus using the shot pump.

BACKGROUND ART

There is a sealant which is made of a main agent and a curing agent, and which is used in a building structure and the like. Conventionally, before such a sealant is used, the main agent and the curing agent are firstly mixed at a predetermined mixing ratio by using a two-liquid mixing apparatus, as described in, for example, Japanese Patent Application Kokai Publication No. 1994-55552.

A gear pump, a trochoidal pump or a shot pump is used for transferring a paste-like adhesive agent with a pressure. However, in the case of using the gear pump or the trochoidal pump, there is a problem that the metering performance is deteriorated due to the leakage of substance caused by a difference in pressure, or due to the wearing of the pump.

For this reason, in a two-liquid metering and mixing apparatus, a main agent and a curing agent are filled respectively in a shot pump for the main agent and in a shot pump for the curing agent, in general. Then, both of the shot pumps are driven by a single drive motor so as to simultaneously push out the main agent and the curing agent. The main agent and the curing agent thus pushed out are mixed through a mixer, and thereafter the mixed agent is discharged.

This shot pump is operated as follows. When a piston provided in a cylinder in the shot pump is raised by a motor drive or a hydraulic drive, a substance to be transferred such as a main agent and a curing agent is sucked into the cylinder. Then, when the piston is lowered, the substance to be transferred is discharged from an outlet. Since the amount of discharge depends on the amount of travel of the piston, the shot pump does not have any problem in the metering performance.

However, the shot pump has a problem that a substance to be transferred remains in the pump, leading to a failure caused by a gelated substance that remains in the shot pump. Specifically, in the conventional shot pump 100X, both of an outlet 104 and an inlet 103 are provided to a cylinder 101 on the bottom portion side facing a tip end of a piston 102, as shown in FIG. 7. When the piston starts to be raised to suck a substance before being completely lowered to the lowest level, a dead flow portion D, where the substance to be transferred hardly moves, is formed in the upper portion of the cylinder, in which portion the substance faces the tip end of the piston. Accordingly, the remaining substance to be transferred in the dead flow portion is not replaced with a substance newly sucked. As a result, the remaining substance in the dead flow portion gelates.

On the other hand, as described in Japanese Patent Application Kokai Publication No. 2000-37654, proposed is a liquid discharging apparatus configured as follows so that liquid can be continuously discharged in terms of the entirety of the liquid discharging apparatus. Specifically, in the liquid discharging apparatus, plural pumping bodies are arranged. Each of the pumping bodies includes a cylinder and an advancing and retreating member (a plunger or a piston). Each of the pumping bodies discharges the liquid in the cylinder in response to the advancing displacement of the advancing and retreating member, and sucks the liquid into the cylinder in response to the retreating displacement of the advancing and retreating member. In addition, as any one of the pumping bodies performs the discharging operation, another one of the pumping bodies is caused to perform the sucking operation or to halt. Among the pumping bodies, there is one in which an inlet is provided to the side face of an end portion of the cylinder, on the large diameter side of the plunger, and in which an outlet is provided to the bottom surface of the other end portion of the cylinder, on the small diameter side of the plunger.

In this configuration, since the liquid is sucked from the inlet on the upper portion of the plunger when the plunger is raised, the liquid passes through the clearance between the plunger and the cylinder, and further, the plunger moves in a direction opposite to the direction in which the liquid flows in the cylinder. Accordingly, since the resistance to the sucking operation is large, this configuration is not fit for a substance to be transferred with a high viscosity, such as a paste-like adhesive agent. In addition, when the clearance between the plunger and the cylinder is increased for reducing the resistance to the sucking operation, a drift is generated, causing a problem that the substance to be transferred in the cylinder is not sufficiently replaced.

Moreover, while gas components contained in the liquid move upward, the liquid is discharged from the outlet on the lower side when the plunger is lowered. For this reason, the gas components are difficult to discharge, leading to a problem that an air pocket is likely to be generated in the cylinder.

Furthermore, as described in Japanese Patent Application Kokai Publication No. 1979-125504, proposed is a liquid pressure-transferring piston pump of a hydraulic control type configured as follows so that the fluid can be continuously discharged with a pressure regardless of the viscosity of the fluid without causing a pulsation of the fluid. Specifically, in the liquid pressure-transferring piston pump, a pump suction port is provided to a cylinder head while a check valve is provided to the inside of a cylinder body. In addition, a fluid introduction port is provided to an end portion of a piston while another check valve and an in-piston fluid introduction port are provided to the inside of the piston. Moreover, a clearance portion is formed between a piston rod and the cylinder body. The clearance portion communicates with the in-piston fluid introduction port, and is also connected to a pump discharge port provided to the cylinder body. Furthermore, the inside diameter of the cylinder body and the outside diameter of the piston rod are set, so that the ratio of the cross-sectional area of the cylinder body to the cross-sectional area of the piston rod is 2:1.

However, in this fluid pressure-transferring piston pump, fluid moves through a space, in front of the piston, in the cylinder body, and also through the clearance portion formed between the cylinder body and the piston rod. Since this fluid pressure-transferring piston pump is configured so that this fluid moves through the check valve inside the piston, the space and the clearance portion are separated from each other by the piston in close contact with the inner wall of the cylinder. Accordingly, the piston is configured to be in surface contact with the cylinder body for the purpose of preventing the fluid from passing between the piston and the cylinder body. With this configuration, it is impossible to solve the problem of the wearing of a piston and the like, which problem is a disadvantage of the conventional shot pump.

Patent Document 1: Japanese Patent Application Kokai Publication No. 1994-55552

Patent Document 2: Japanese Patent Application Kokai Publication No. 2000-37654

Patent Document 3: Japanese Patent Application Kokai Publication No. 1979-125504

DISCLOSURE OF THE INVENTION

Problem to be Solved by the Invention

The present invention has been made in consideration of the above-described problem. An object of the present invention is to provide a shot pump which makes it possible to prevent a substance to be transferred from remaining in the pump, and to prevent gelation of the substance associated with any remaining part, while securing the constant discharge performance, and which can thus be used over a long period of time with no maintenance, and also to provide a variable-speed-type two-liquid metering and mixing apparatus using the shot pump.

Means for Solving the Problem

A shot pump for achieving the above-described object comprises a cylinder and a piston; the piston being reciprocated in the cylinder from its one end side to its other end side to take by suction a substance to be transferred from an inlet into the pump and discharge the substance from an outlet. In the shot pump, a clearance is provided between outer periphery of the piston and an inner periphery of the cylinder, which clearance has a width at a ratio of 1/50 to 2 to the outer diameter of the piston. In addition, the inlet is provided on the side of the cylinder facing a tip end of the piston and the outlet is provided on the side of the cylinder at a root of the piston. The substance to be transferred is sucked in from inlet, passed through the clearance and then discharged from the outlet.

A variable-speed-type two-liquid metering and mixing apparatus of the present invention comprises a shot pump for a main agent and a shot pump for a curing agent, respectively into which a main agent and a curing agent are charged from respective substance supply sources; a speed-controllable driving motor provided to each of the shot pump for main agent and the shot pump for curing agent for driving respective shot pumps to pump out the main agent and the curing agent respectively in a predetermined mixing ratio; and a mixer for mixing the pushed out agents together and discharging an agent mixture, whereby the predetermined mixing ratio is set at will by controlling the rotation speed of the speed-controllable driving motors. In the variable-speed-type two-liquid metering and mixing apparatus, the pressure under which the substance to be transferred, i.e. the main agent and the curing agent, are discharged from the shot pump for main agent and the shot pump for the curing agent respectively can be set at a predetermined constant value respectively. Each shot pump comprises a cylinder and a piston and is provided with a clearance between outer periphery of the piston and an inner periphery of the cylinder, which clearance has a width at a ratio of 1/50 to 2 to the outer diameter of the piston. In each shot pump, an inlet is provided on the side of the cylinder facing a tip end of the piston, an outlet is provided on the side of the cylinder at a root of the piston. In addition, the substance to be transferred is sucked in from the inlet when the piston is moved from one end side to the other end side of the cylinder and when the piston is moved from the other end side to the one end side of the cylinder. The substance to be transferred is passed through the clearance and then discharged from the outlet.

Effect of the Invention

In the shot pump and the variable-speed-type two-liquid metering and mixing apparatus of the invention, since the inlet for the substance to be transferred is positioned on the side of the bottom portion of the cylinder, which faces the tip end of the piston, while the outlet for the substance to be transferred is positioned on the root of the piston, the substance inside the cylinder is discharged while being replaced. For this reason, dead flow does not occur.

Accordingly, it is possible to prevent the substance to be transferred from remaining inside the shot pump, and to thus prevent gelation of the substance associated with any remaining part, while securing the constant discharge performance, which is a feature of the shot pump. This makes it possible to continuously use the shot pump over a long period of time with no maintenance.

In addition, since the substance to be transferred is sucked from the inlet on the lower side of the cylinder when the piston is raised, the piston moves in the same direction as that in which the substance to be transferred flows in the cylinder. Accordingly, the resistance to the sucking operation is small. On the other hand, when the substance to be transferred passes through the clearance between the piston and the cylinder, the shot pump is in a pressurized state where a large pressure can be generated. For this reason, the substance to be transferred can be discharged, even when the clearance is narrowed so that all the substance to be transferred in the clearance can be replaced. Accordingly, the shot pump can sufficiently handle a substance to be transferred with a high viscosity, such as a paste-like adhesive agent.

Moreover, since gas components contained in the substance to be transferred move upward, reach the upper portion of the cylinder, and are then discharged from the outlet together with the substance to be transferred, an air pocket is not generated in the cylinder. Accordingly, since mixing at an accurate ratio can be performed, the hardening or the separation of substances can be eliminated. This makes it possible to improve the quality of products.

Furthermore, the substance to be transferred is caused to pass through the clearance between the side face of the piston and the inner side face of the cylinder, the piston and the cylinder can be kept from being in contact with each other. As a result, it is possible to solve a problem that the piston or the cylinder wears.

BEST MODE FOR CARRYING OUT THE INVENTION

Figure 1:
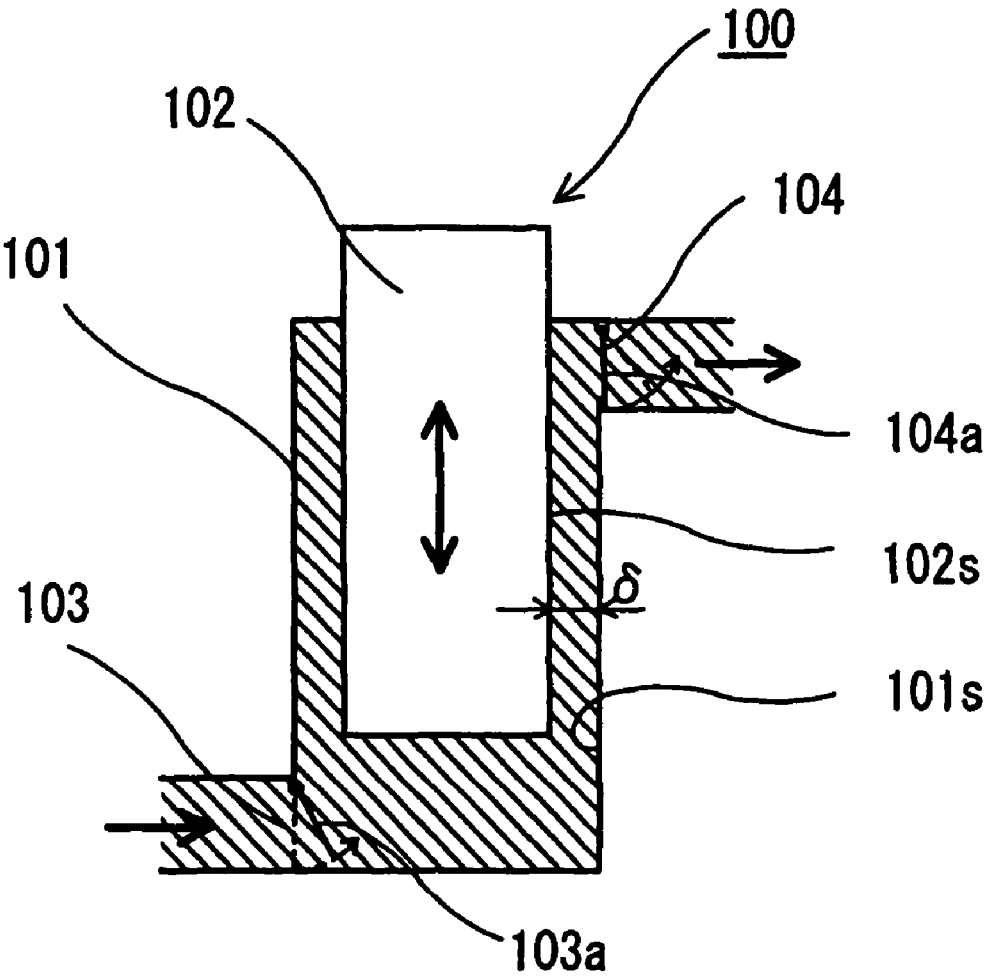
FIG. 1 is a diagram showing a structure of a shot pump of an embodiment of the present invention.

Firstly, descriptions will be given of an embodiment of a shot pump according to the present invention with reference to FIG. 1. This shot pump 100 includes a cylinder 101 and a piston 102. An inlet 103 for a substance to be transferred is provided on side of the cylinder 101 (the lower end side of the cylinder in FIG. 1) facing a tip end of the piston 102. The inlet 103 being prvided at a lower end portion in a side face of the cylinder 101 so as to be contiguous to a lower end face of the cylinder 101, without a step difference between the lower end surface of the inlet and the lower end surface of the cylinder. In addition, an outlet 104 is provided on the side of the cylinder 101 (the upper end side of the cylinder in FIG. 1) at a root of the piston. The outlet 104 being provided at an upper end portion in the side face of the cylinder 101 so as to be contiguous to an upper end face of the cylinder 101, without a step difference between the upper end surface of the outlet and the upper end surface of the cylinder.

In addition, the cylinder 101 and the piston 102 are formed in a manner that the clearance δ is provided between the outer periphery 102*s* of the piston and the inner periphery 101*s* of the cylinder 101, which has a width at a ratio of 1/50 to 2 to the outside diameter of the piston 102. Moreover, the inlet 103 and the outlet 104 are provided respectively with check valves 103*a* and 104*a* (not illustrated), so that the substance to be transferred is allowed to flow in, or to flow out, in only one direction.

With this configuration, the piston 102 provided inside the cylinder 101 is raised or lowered by an unillustrated motor drive or an unillustrated hydraulic drive. The substance to be transferred is sucked from the inlet 103 when the piston 102 is raised, then passes through the clearance δ to be discharged from the outlet 104 when the piston 102 is lowered. When the ratio of the clearance δ to the outside diameter of the piston 102 is not less than 1/50, a paste-like adhesive agent or the like is allowed to flow into the clearance δ. In other words, it is possible to prevent the substance to be transferred from remaining in the cylinder. On the other hand, since the clearance δ is not more than 2, it is possible to allow the substance to be securely replaced at the portion of the clearance δ while securing the constant discharge performance. In particular, when this shot pump 100 is employed for a substance to be transferred with a high viscosity, it is preferable to apply a pressure of approximately 10 MPa to the substance to be transferred with a pressure pump because the piston is raised by the pressure so that the suction can be facilitated.

Accordingly, it is possible to prevent the substance from remaining inside the shot pump, and to thus prevent gelation of the substance associated with the remaining part, while securing the constant discharge performance, which is a feature of the shot pump. As a result, it is possible to continually use the shot pump over a long period of time with no maintenance.

Moreover, since the substance to be transferred passes through the clearance δ between the outer periphery 102*s* of the piston 102 and the inner periphery 101*s* of the cylinder 101, the piston 102 and the cylinder 101 are kept in non-contact with each other. Accordingly, it is possible to solve a problem that the piston 102, the cylinder 101 and the like wear.

Figure 2:
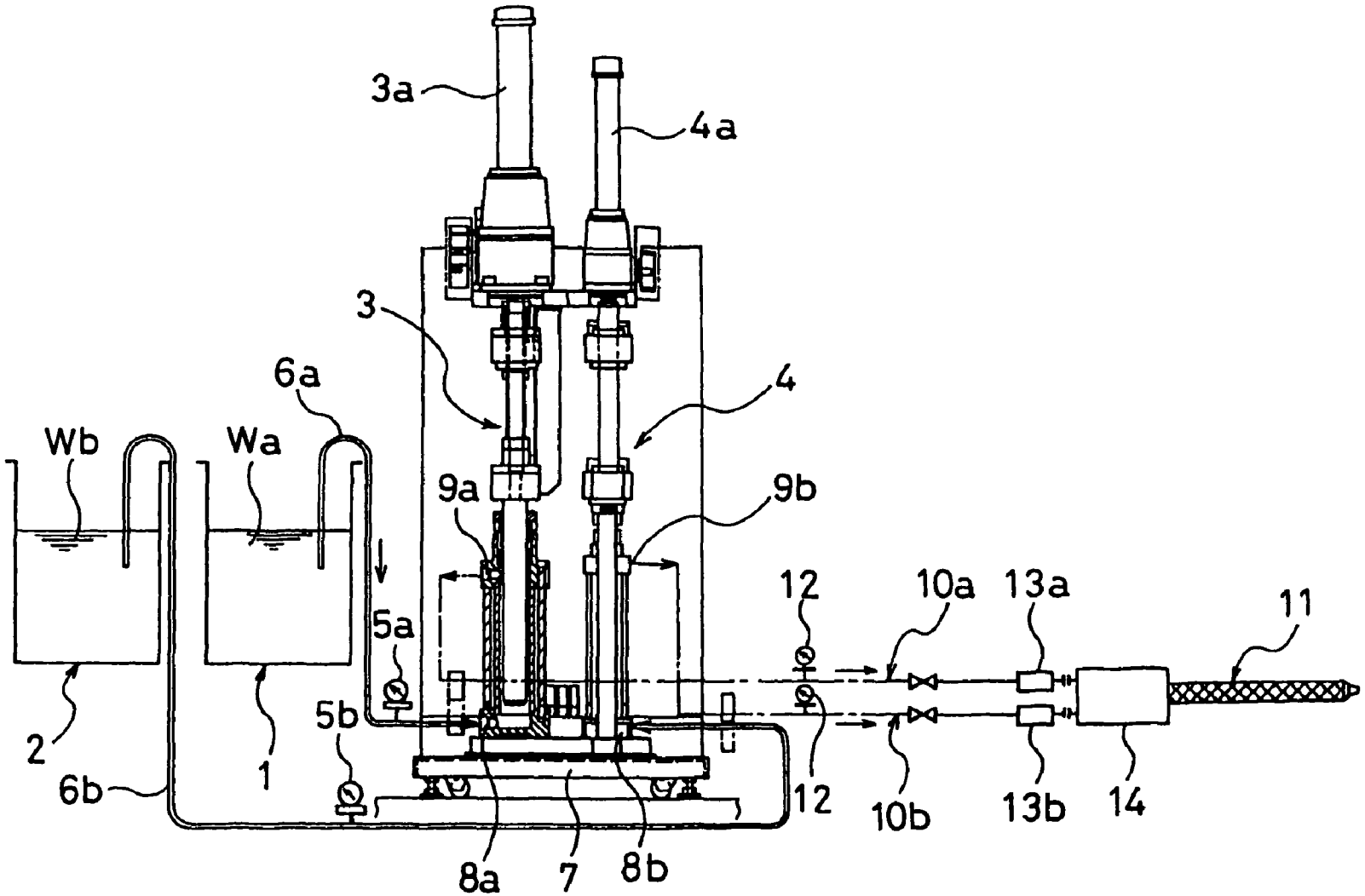
FIG. 2 is a schematic configurational view of a variable-speed-type two-liquid metering and mixing apparatus of an embodiment of the present invention.
Figure 3:
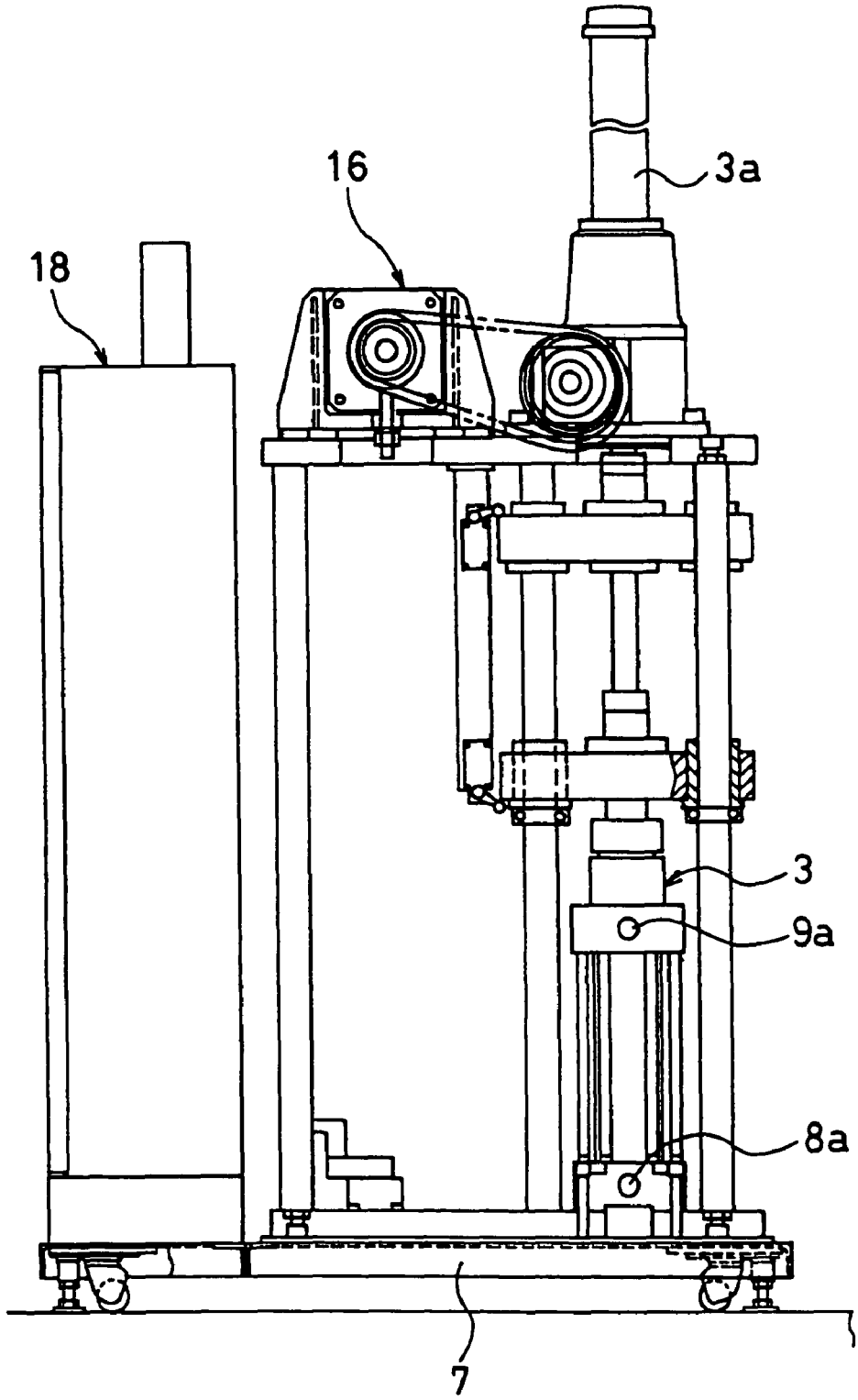
FIG. 3 is a left-side view of the variable-speed-type two-liquid metering and mixing apparatus of FIG. 2.
Figure 4:
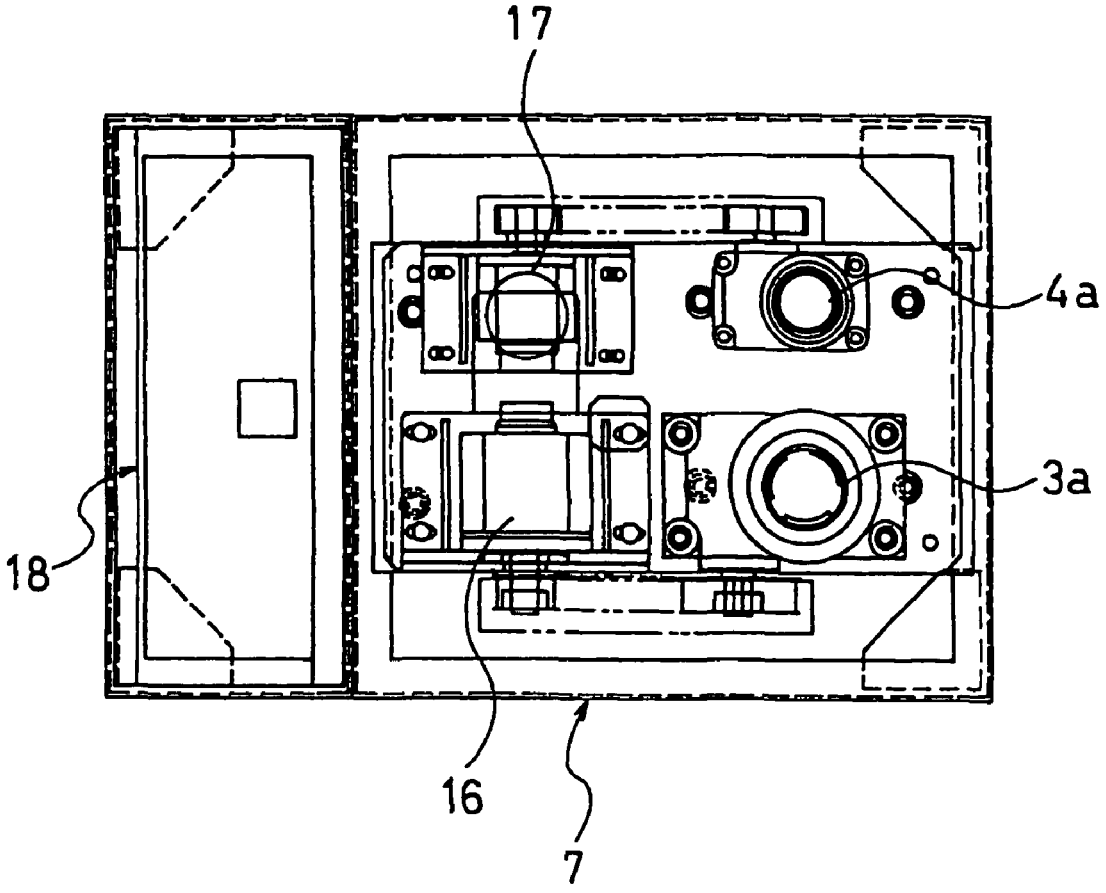
FIG. 4 is a plan view of the variable-speed-type two-liquid metering and mixing apparatus of FIG. 2.
Figure 5:
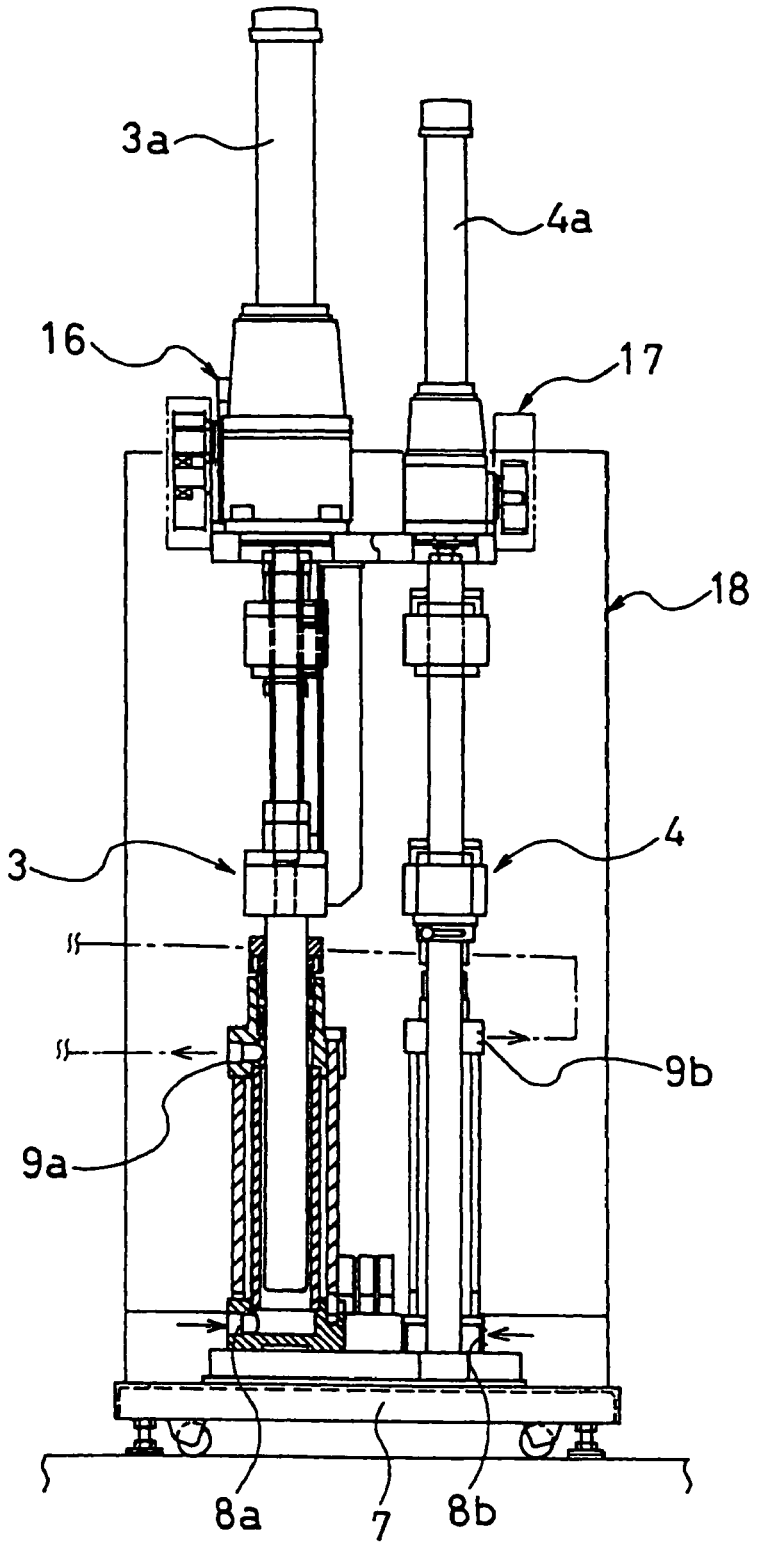
FIG. 5 is a front view of the variable-speed-type two-liquid metering and mixing apparatus of FIG. 2.
Figure 6:
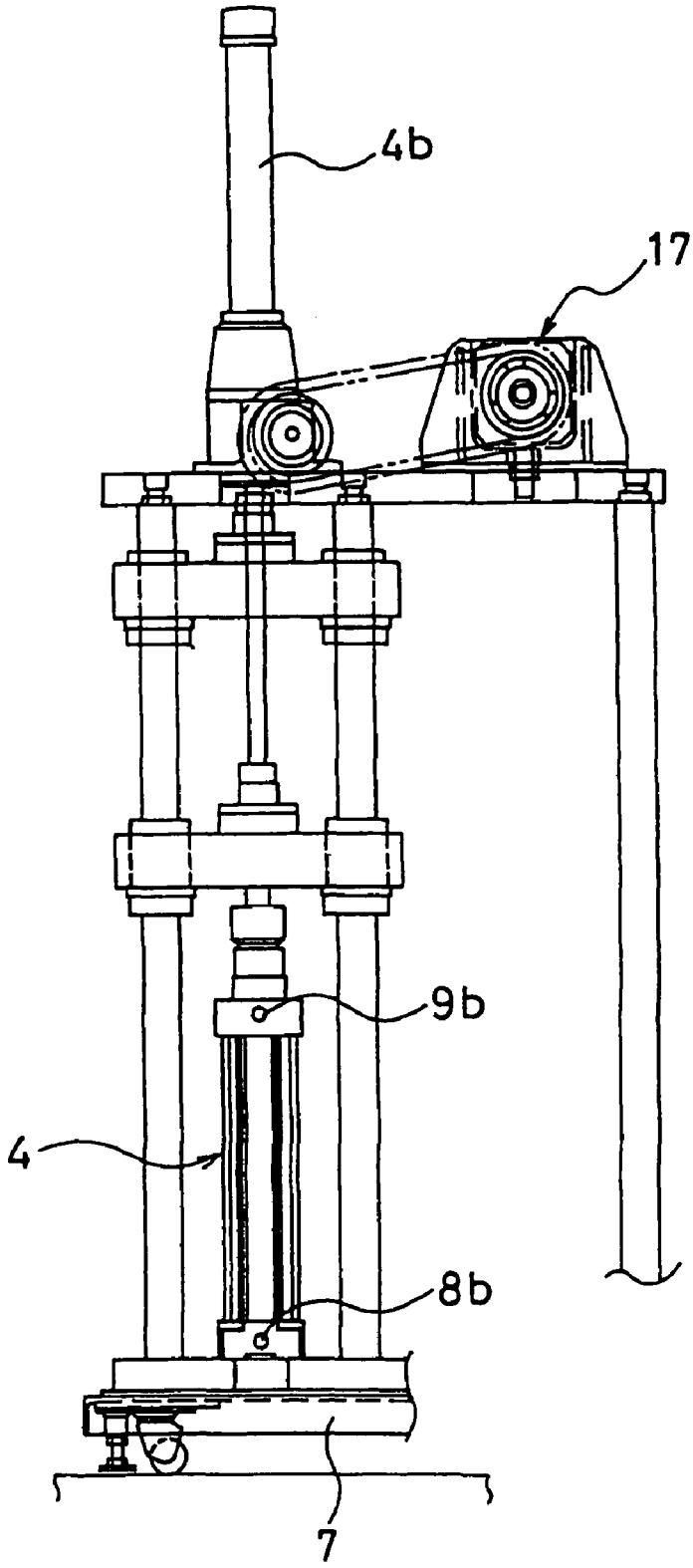
FIG. 6 is a right-side view of the variable-speed-type two-liquid metering and mixing apparatus of FIG. 2.
Figure 7:
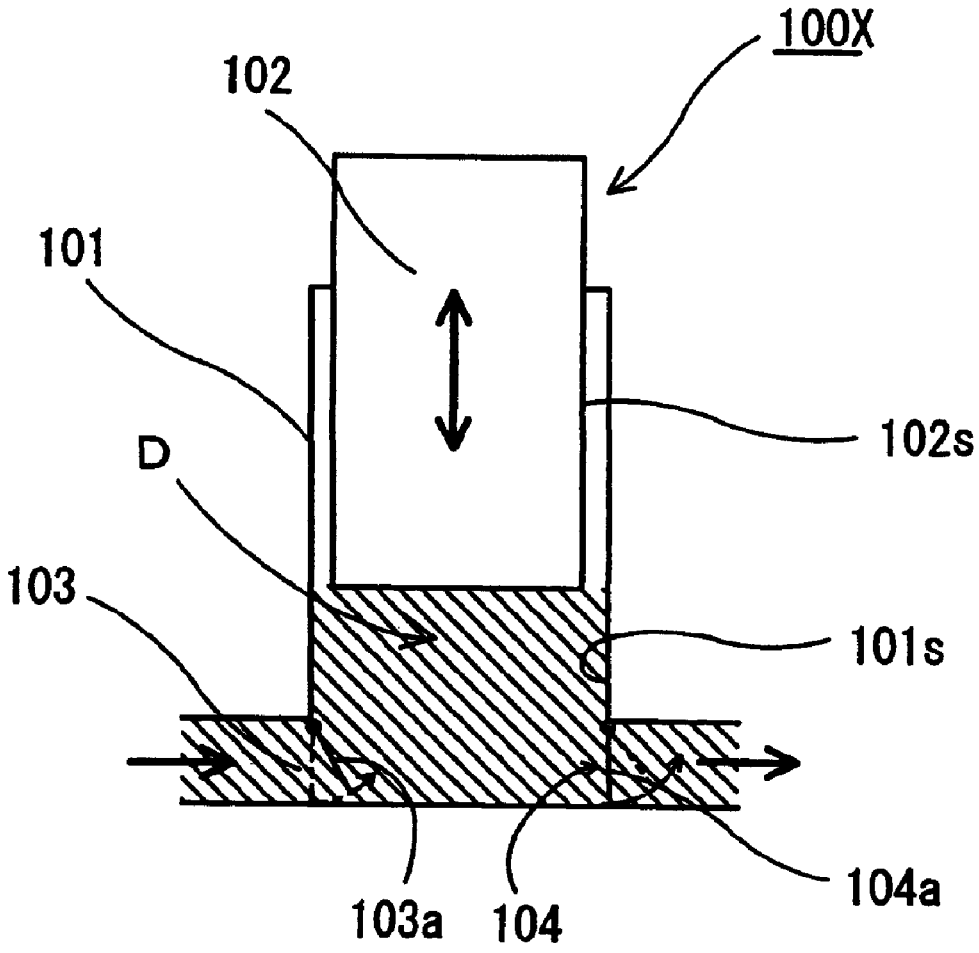
PRIOR ART Fig.7
FIG. 7 is a diagram showing a structure of a shot pump of a conventional technique.

Next, descriptions will be given of a variable-speed-type two-liquid metering and mixing apparatus according to an embodiment of the present invention with reference to FIG. 2 to FIG. 6. FIG. 2 shows a schematic view of the entire configuration of a device for implementing a variable-speed-type two-liquid metering and mixing control method. A main agent Wa is supplied from a substance supply source (for example, a pail can) 1 through a pipe 6*a*, which is provided with a pressure gauge 5*a*, to a shot pump 3 for the main agent, which is driven by an elevator cylinder 3*a*. On the other hand, a curing agent Wb is supplied from a substance supply source (for example, a pail can) 2 through a pipe 6*b*, which is provided with a pressure gauge 5*b*, to a shot pump 4 for the curing agent, which is driven by an elevator cylinder 4*a*.

In the present invention, each of the shot pump 3 for the main agent and the shot pump 4 for the curing agent is constituted of the above-described shot pump 100. These shot pumps 3 and 4 are mounted on a movable frame 7. A filling inlet 8*a* for the main agent Wa and a filling inlet 8*b* for the curing agent Wb are provided respectively below the shot pump 3 for the main agent and the shot pump 4 for the curing agent. Each of the filling inlets 8*a* and 8*b* corresponds to the inlet 103 of the above-described shot pump 100. The pipes 6*a* and 6*b* are connected respectively to the filling inlets 8*a* and 8*b*. In addition, a discharging outlet 9*a* for the main agent Wa and a discharging outlet 9*b* for the curing agent Wb are provided respectively on the upper side of the shot pump 3 for the main agent and the shot pump 4 for the curing agent. Each of the discharging outlets 9*a* and 9*b* corresponds to the outlet 104 of the above-described shot pump 100.

Moreover, the discharging outlet 9*a* of the shot pump 3 for the main agent and the discharging outlet 9*b* of the shot pump 4 for the curing agent are connected to a mixer 11, such as a static mixer, with pipes 10*a* and 10*b* in between, respectively. The pipes 10*a* and 10*b* are provided with a mixing unit 14 including pressure sensors 12, and air or electromagnetic valves 13*a* and 13*b*. The mixer 11, such as a static mixer (or, a dynamic mixer) is attached to the mixing unit 14.

The shot pump 3 for the main agent and the shot pump 4 for the curing agent are provided respectively with a drive motor 16 which drives the shot pump 3 and a drive motor 17 which drives the shot pump 4, as shown in FIG. 3 to FIG. 6. The drive motors 16 and 17 are so configured that the rotational speeds of the drive motors 16 and 17 can be controlled by operating a control device 18. Specifically, by operating the control device 18 to control the rotational speeds of the drive motors 16 and 17, it is possible to arbitrarily set the mixing ratio of the main agent Wa filled in the shot pump 3 for the main agent and the curing agent Wb filled in the shot pump 4 for the curing agent.

Next, descriptions will be given of the variable-speed-type two-liquid metering and mixing control method in the variable-speed-type two-liquid metering and mixing apparatus with the above-described configuration.

The main agent Wa and the curing agent Wb, which are supplied respectively from the substance supply sources 1 and 2, are filled respectively in the shot pump 3 for the main agent and the shot pump 4 for the curing agent through the corresponding filling inlets 8*a* and 8*b*. At this time, the rotational speeds of the drive motors 16 and 17 provided respectively to the shot pumps 3 and 4 are controlled by operating the control device 18, so that the mixing ratio of the main agent Wa and the curing agent Wb is arbitrarily set.

In addition, a pressure at the completion of the discharging is set in the pressure sensor 12 provided between each of the shot pumps 3 and 4, and a corresponding one of the valves 13*a* and 13*b*, so that the pressure in each of the shot pumps 3 and 4 is set at a constant value. Then, the main agent Wa and the curing agent Wb with the set mixing ratio are transferred through the mixing unit 14 provided with the valves 13*a* and 13*b* to the mixer 11. The main agent Wa and the curing agent Wb to be thus transferred are mixed by the mixer 11, and are then discharged, while the total discharge amount of the main agent Wa and the curing agent Wb is made constant.

In this control method, by controlling the mixing of the main agent Wa and the curing agent Wb with the control method as described above, it is possible to set freely the mixing ratio of the main agent Wa and the curing agent Wb. Accordingly, it is possible to mix substances with any different mixing ratio. Moreover, since it is not necessary that devices respectively for different mixing ratios be installed individually, the costs can be reduced. Furthermore, since this method makes it possible to reduce time required for the substance development, the substance development can be facilitated.

In addition, since it is possible to set the pressure at the completion of the charging at a constant value for each of the shot pumps 3 and 4, a failure in the ratio of the ejection amounts is eliminated. Accordingly, it is possible to prevent an adhesive failure. Moreover, since a dead stock can be eliminated, it is possible to prevent an air pocket from occurring, and to thus perform mixing at an accurate ratio. As a result, since the hardening or the separation of materials can be eliminated, it is possible to improve the quality of products.

According to the variable-speed-type two-liquid metering and mixing apparatus with the above-described configuration, it is possible to set freely the mixing ratio of the main agent and the curing agent in one single variable-speed-type two-liquid metering and mixing apparatus. This makes it possible to mix materials with any different mixing ratio. In addition, since there is no need for individually having devices with different mixing ratios, the costs can be reduced. Moreover, since it is possible to reduce time required for substance development, the substance development can be facilitated.

Additionally, since it is possible to set the pressure at the completion of discharging substances at a constant value for each shot pump, a failure in the ratio of the ejection amounts is eliminated. Accordingly, it is possible to prevent an adhesive failure.

Moreover, since the shot pump 100 with the configuration of FIG. 1 is used, as the shot pump 3 for the main agent, and as the shot pump 4 for the curing agent, it is possible to prevent a substance to be transferred from remaining inside the shot pump, and to thus prevent gelation of the substance associated with the remaining, while securing the constant discharge performance. Accordingly, it is possible to continually use the shot pumps over a long period of time with no maintenance.

Furthermore, the eliminating of a dead stock makes it possible to prevent an air pocket from occurring, enabling mixing at an accurate ratio. As a result, since the hardening or the separation of materials can be eliminated, it is possible to improve the quality of products.

INDUSTRIAL APPLICABILITY

The present invention makes it possible to prevent a substance to be transferred from remaining inside the shot pumps, and to thus prevent gelation of the substance associated with the remaining, while securing the constant discharge performance. Accordingly, it is possible to continually use the shot pumps over a long period of time with no maintenance. In addition, according to the present invention, since an air pocket does not occur, it is possible to achieve mixing at an accurate ratio. For this reason, it is possible to eliminate the hardening and separation of substances, thus improving the quality of products. Consequently, the present invention can be applied to a shot pump that transfers a paste-like adhesive agent or the like, and to a variable-speed-type two-liquid metering and mixing apparatus utilizing the shot pump.

What is claimed is:

1. A shot pump comprising:

a cylinder standing upright in a vertical direction;

an inlet having a check valve which allows a paste-like transferred substance to only flow into the cylinder therethrough, the inlet being provided at a lower end portion in a side face of the cylinder so as to be contiguous to a lower end face of the cylinder without a step difference between the lower end surface of the inlet and the lower end surface of the cylinder;

an outlet having a check valve which allows the transferred substance to only flow out of the cylinder therethrough, the outlet being provided at an upper end portion in the side face of the cylinder so as to be contiguous to an upper end face of the cylinder without a step difference between the upper end surface of the outlet and the upper end surface of the cylinder; and a piston configured to vertically reciprocate in the cylinder so as to cause the transferred substance to be sucked from the inlet and then to be discharged from the outlet, wherein the ratio of a clearance between a side face of the piston and an inner side face of the cylinder to an outside diameter of the piston is 1/50 to 1/2, and the transferred substance is sucked from the inlet, is then caused to pass through the clearance between the side face of the piston and the inner side face of the cylinder, and is discharged from the outlet.

2. The shot pump according to claim 1, wherein the inlet and the outlet are arranged respectively in portions opposite to each other of the side face in a vertical cross section of the cylinder.

3. A variable-speed-type two-liquid metering and mixing apparatus comprising:

a shot pump for a main agent, in which the main agent is filled from a material supply source while the pressure at the completion of the filling is settable at a predetermined constant value;

a shot pump for a curing agent, in which the curing agent is filled from a material supply source while the pressure at the completion of the filling is settable at a predetermined constant value;

drive motors which are provided respectively to the shot pump for the main agent and the shot pump for the curing agent;

a mixer, wherein the main agent and the curing agent are pushed out from the corresponding shot pumps driven respectively by the drive motors, and are mixed by the mixer while the mixing ratio of the main agent and the curing agent can be set at an arbitrarily predetermined ratio by controlling the rotational speeds of the respective drive motors, and the resultant mixed agent is then discharged, each shot pump includes: a cylinder standing upright in a vertical direction; an inlet having a check valve which allows a paste-like transferred substance to only flow into the cylinder therethrough, the inlet being provided at a lower end portion in a side face of the cylinder so as to be contiguous to a lower end face of the cylinder without a step difference between the lower end surface of the inlet and the lower end surface of the cylinder; an outlet having a check valve which allows the transferred substance to only flow out of the cylinder therethrough, the outlet being provided at an upper end portion in the side face of the cylinder so as to be contiguous to an upper end face of the cylinder; without a step difference between the upper end surface of the outlet and the upper end surface of the cylinder; and a piston, wherein the ratio of a clearance between a side face of the piston and an inner side face of the cylinder to an outside diameter of the piston is 1/50 to 1/2, and the transferred substance is sucked from the inlet when the piston moves from a lower end side to an upper end side of the cylinder, and the transferred substance is then caused to pass through the clearance between the side face of the piston and the inner side face of the cylinder so as to be discharged from the outlet when the piston moves from the upper end side to the lower end side of the cylinder.

* * * * *